United States Patent [19]

Tait

[11] 4,240,925

[45] Dec. 23, 1980

[54] INHIBITION OF PITTING CORROSION

[75] Inventor: William S. Tait, St. Louis, Mo.

[73] Assignee: Petrolite Corporation, St. Louis, Mo.

[21] Appl. No.: 930,280

[22] Filed: Aug. 2, 1978

[51] Int. Cl.[3] ..... C23F 11/16; C23F 11/12; C23F 11/14

[52] U.S. Cl. ..... 252/389 A; 106/14.12; 106/14.13; 106/14.16; 148/6.15 R; 252/8.55 E; 252/180; 422/15; 422/16; 422/17; 422/18

[58] Field of Search ..... 252/389 A, 180, 8.55 E; 148/6.15 R; 210/59; 106/14.12, 14.13, 14.16; 422/15, 16, 17, 18

[56] References Cited

U.S. PATENT DOCUMENTS

| | | | |
|---|---|---|---|
| 3,716,569 | 2/1973 | Redmore et al. | 260/448.8 R |
| 3,803,047 | 4/1974 | Hwa | 252/389 A |
| 3,816,184 | 6/1974 | Redmore et al. | 252/389 A |
| 4,014,814 | 3/1977 | Zecher | 252/389 A |
| 4,033,896 | 7/1977 | Mitchell et al. | 252/389 A |
| 4,072,626 | 2/1978 | Finney | 252/389 A |
| 4,134,959 | 1/1979 | Merke et al. | 252/389 A |

*Primary Examiner*—Benjamin R. Padgett
*Assistant Examiner*—Irwin Gluck
*Attorney, Agent, or Firm*—Sidney B. Ring; Hyman F. Glass

[57] ABSTRACT

This invention relates to a process of inhibiting pitting corrosion which is characterized by the use of synergistic mixtures of organic anodic and cathodic corrosion inhibitors. These synergistic mixtures effectively inhibit pitting corrosion in highly oxygenated systems without the conventional use of heavy metals such as zinc (Zn) or chromium (Cr). This invention also relates to the use of alkoxysilyl alkylene polyamines as pitting corrosion inhibitors.

11 Claims, No Drawings

INHIBITION OF PITTING CORROSION

Included among the several forms of corrosion which can cause the failure of metallic equipment exposed to oxygen-bearing water are general and pitting corrosion. General corrosion proceeds over the entire metal surface and can readily be inhibited with organic structures such as those mentioned in U.S. Pat. Nos. 3,989,637; 3,837,803; 3,836,463 and 3,816,184. Pitting corrosion occurs at small discrete locations on the metal surface and penetrates the metal 20–100 times faster than general corrosion. This leads to much earlier failure of metallic equipment than if just general corrosion were present.

Although organic inhibitors have been widely used to inhibit general corrosion, with the hope that they would also reduce pitting corrosion, it is conventionally believed that pitting corrosion could not be effectively inhibited in highly oxygenated systems without employing heavy metals such as Zn or Cr. This is illustrated in U.S. Pat. No. 3,837,803.

I have now discovered that pitting corrosion can be effectively inhibited without heavy metals such as Zn or Cr.

I have further discovered that pitting corrosion can be effectively inhibited with organic inhibitors even in the absence of An or Cr.

I have further discovered that certain synergistic mixtures of organic inhibitors effectively inhibit pitting corrosion, particularly where the mixture of organic inhibition is a blend of both anodic and cathodic organic inhibitors.

Since it is conventionally believed that pitting corrosion is not inhibited with organic inhibitors, contemporary organic inhibitors are designed to combat only general corrosion. This can be readily seen upon examination of U.S. Pat. Nos. 4,048,065; 4,010,111; 3,989,637; 3,837,803; 3,816,333; 3,793,194; 3,711,246; 3,687,610.

The fact that general corrosion may be inhibited with organic corrosion inhibitors, without the inhibition of pitting corrosion, is demonstrated in the following table.

TABLE I

| Inhibitor | Gen. Corr. Rates (Mils per year) | Pitting Corr. (Rate (Mils/Yr.) |
|---|---|---|
| Phosphorylated ethoxylated (U.S. Pat. No. 3,636,142) trimethylol propane | 12 | 285 |
| Phosphonylated polyethylene polyamine (U.S. Pat. No. 3,235,627) | | |
| Phosphorylated $C_8$–$C_{10}$ alcohol mixture (U.S. Pat. No. 4,012,440) | 9 | 250 |
| Phosphorylated aminoethyl piperazine (U.S. Pat. No. 3,954,761) | 50 | 580 |
| Phosphorylated bishexamethylene triamine (U.S. Pat. No. 3,613,788) | 14 | 90 |
| No inhibitor | 60 | 940 |

Methods for measuring the rate of general corrosion are described in U.S. Pat. Nos. 3,687,610 (weight loss) and 3,406,101 (linear polarization).

This invention provides a method whereby pitting corrosion of metals, such as occurs when metals are exposed to oxygen-bearing water, can be inhibited by mixture of specific organic inhibitor without the use of heavy metals such as chromium and zinc.

Pitting rates were measured by the use of three metal electrodes submerged in the corrosive water and a silver-silver chloride reference electrode submerged in same fluid. These electrodes were used to obtain the non-linear, anodic and cathodic polarization curves.

A polarization curve is a plot of the log of the current passed between a test and auxiliary electrode against the potential between the test and aforementioned reference electrode. The anodic curve is the curve generated at potentials more positive than the open circuit potential and the cathodic curve is the curve generated at potentials more negative than the open circuit potential. A more complete description of these curves is contained in the following publication:

N. D. GREENE, *CORROSION*, 15, p. 47 (1959)

Corrosion processes consist of two electrochemical half reactions, designated as anodic and cathodic, which are coupled together to produce the overall corrosion reaction.

For a metal exposed to a corrosive fluid, the anodic reaction is the oxidation of metal atoms into their ions with a simultaneous release of electrons. An example of this, for iron in oxygen-saturated water, is:

$$Fe \rightarrow Fe^{+2} + 2e^- \text{ anodic (oxidation) reaction.}$$

The electrons released in the anodic reaction are consumed by the cathodic reaction. An example of this is oxygen in water:

$$\tfrac{1}{2}O_2 + H_2O + 2e^- \rightarrow 2OH^- \text{ cathodic (reduction) reaction.}$$

The molecular species which consumes the electrons (Oxygen in the above example) is referred to as a cathodic depolarizer. Hence the cathodic depolarizer is reduced by the electrons released in the anodic reaction.

The two half reactions are coupled together to form the overall corrosion reaction. For example:

$$Fe \rightarrow Fe^{+2} + 2e^- \text{ anodic (oxidation) reaction}$$

$$\tfrac{1}{2}O_2 + H_2O + 2e^- \rightarrow 2OH^-$$

cathodic (reduction) reaction $$Fe + \tfrac{1}{2}O_2 + H_2O \rightarrow Fe(OH)_2$$

overall corrosion reaction.

Both half reactions need to be present in order for corrosion to take place.

The terms anodic and cathodic are used only to describe the oxidation of metal and reduction of depolarizer. They do not describe a particular manner in which the oxidation and reduction reactions are caused to occur. Terms like general and pitting corrosion are used to describe how the oxidation (anodic) and reduction (cathodic) reactions are initiated and propagated.

General corrosion is initiated and propagated by the diffusion of the cathodic depolarizer to the metal surface for subsequent reaction. General corrosion proceeds uniformly over the entire metal surface. When a layer of corrosion product (e.g. iron oxides) covers the metal surface the rate at which general corrosion penetrates the metal is determined by how fast the cathodic depolarizer can diffuse through the corrosion product layer to reach the metal surface.

Pitting corrosion proceeds in two distinct steps; (1) Nucleation and (2) subsequent pit growth. Pits are nucleated by the formation of oxygen concentration (sometimes referred to as differential aeration) cells on the surface of the metal. These concentration cells are generated by stifling the flow of oxygen (depolarizer) to the metal surface at small discrete areas (these small areas can be as small as 1/70,000 of the rest of the metal surface). Thus you have very small areas on the metal surface which have essentially no oxygen (depolarizer) reaching them in contact with a very large area which has a relatively high amount of oxygen (depolarizer) reach it. This concentration gradient of oxygen is the concentration cell. The concentration cell causes pits to nucleate at the small areas (where the amount of oxygen reaching the metal surface is lowest). The stifling of the oxygen flow to these small areas is usually caused by the covering of these areas with particles of dirt, sand, bacteria colonies, etc.

Once the pit has been nucleated it continues to grow at a rate proportional to the aforementioned oxygen (depolarizer) concentration gradient.

For metals exposed to oxygen-bearing water both general and pitting corrosion are usually present.

An inhibitor which inhibits the oxidation of metal (anodic reaction) is referred to as an anodic inhibitor. Conversely an inhibitor which inhibits the reduction (cathodic) reaction is referred to as a cathodic inhibitor. Since the mechanisms by which anodic and cathodic reactions are generated differ for general and pitting corrosion so do the inhibitors which can be used to inhibit their respective anodic and cathodic reactions. This is why the approach of designing inhibitors for general corrosion does not usually concurrently produce a pitting inhibitor. This is demonstrated by the data in Table I. Selection of general corrosion inhibitors which have subsequently also inhibited pitting corrosion has in the past been a matter of pure luck. In contrast, this invention inhibits pitting corrosion as well as general corrosion.

For this invention an anodic inhibitor was distinguished from a cathodic inhibitor by noting its effect on the height of the prospective non-linear anodic polarization curve with respect to non-linear curves obtained from an identical uninhibited system. Thus a cathodic inhibitor lowers the height of the non-linear cathodic polarization curve and an anodic inhibitor the non-linear anodic polarization curve. Inhibitors which lower non-linear polarization curves will not usually lower the height of linear polarization curves used for measuring general corrosion. The reason for this has been discussed above. (Thus linear polarization cannot be usually used to measure pitting corrosion.)

These non-linear polarization curves are obtained from potentiodynamic scanning. The potentiodynamic method uses a potentiostat, such as the Petrolite Potentiodyne TM Analyzer, to generate the cathodic and anodic curves. This is done by varying the potential between the reference and cathode or anode (depending upon which curve is being genrated) and measuring the current being passed between the auxiliary and polarized electrode (this current being required to maintain the desired potential between the reference and polarized electrodes). The log current is plotted as a function of potential. The cathodic scan (curve) is usually terminated around 300–600 millivolts from the corrosion potential. Unlike the cathodic scan the anodic scan is reversed (instead of terminated) when the applied current reaches a value of 50 milliamps. The potential is subsequently driven backwards until the current reaches a value of approximately zero. The intersection of the reverse anodic scan (curve) with the cathodic curve or cathodic curve extrapolation gives the current, which is directly proportional to the pitting rate, designated the pitting current density. This method is further described in:

1. J. B. Harrell, R. L. Martin and S. P. Gaydos, *CORROSION* 1976, paper No. 48
2. R. L. Martin, *CORROSION* 1977, paper No. 140
3. W. S. Tait, *CORROSION*, 34(6), p. 214, 1978.

I have discovered that certain organic structures which are capable of suppressing the magnitude of the non-linear anodic curve can be combined with one that suppresses the magnitude of the non-linear cathodic curve to produce a superior organic pitting inhibitor. The use of heavy metals such as chromium or zinc is thus not essential to inhibit pitting corrosion.

Illustrative examples of anodic and cathodic inhibitors suitable as pitting corrosion inhibitors are presented in Table 2 below.

TABLE II

| Examples of Organic Cathodic and Anodic Inhibitors: | % Pitting Inhibitor |
|---|---|
| CATHODIC | |
| Phosphorylated pentaerythritol | 86 |
| Phosphorylated (trimethoxysilypropyl)ethylene diamine | 98 |
| Phosphonylated diethylenetriamine | 89 |
| ANODIC | |
| 2-hydroxy 1,2,3 propanetricarboxylic acid | 82 |
| Benzoic acid, 3,4,5 trihydroxy | 50 |
| 2-phosphono-butane-tricarboxylic acid 1,2,4 | 75 |
| 2-mercaptobenzothiazole | 8 |
| 5,5' Indigosulfonic acid | 32 |
| Maleic acid | 33 |
| Benzaldehyde, 4-hydroxy-3-methoxy | 21 |

EXAMPLES

Table III below illustrates how blending an anodic and cathodic inhibitor can produce a synergistic affect on pitting corrosion:

TABLE III

| Inhibitor | % Pitting Inhibition | % General Corrosion Inhibition |
|---|---|---|
| ANODIC | | |
| Benzaldehyde, 4-hydroxy, 3-methoxy | 21 | 30 |
| CATHODIC | | |
| Phosphorylated Pentaerythritol | 86 | 81 |
| BLEND OF THE ABOVE (1:1 by weight) | 95 | 81 |

In addition where phosphylated pentaerythritol with a % pitting inhibition of 86% is blended with an equal weight of benzoic acid, 3,4,5 trihydroxy—with a % pitting inhibition of 50%, the resulting blend has a % pitting inhibition of 86%, thus upgrading benzoic acid 3,4,5-trihydroxy—as presented in Table IV.

TABLE IV

| Inhibitor | % Pitting Inhibition |
|---|---|
| ANODIC | |
| Phosphorylated Pentaerythritol | 86 |
| CATHODIC | |

TABLE IV-continued

| Inhibitor | % Pitting Inhibition |
|---|---|
| Benzoic acid, 3,4,5 trihydroxy | 50 |
| Blend of above (1:1 by wgt.) | 86 |

The synergistic blends of cathodic and anodic corrosion inhibitors of this invention can also be employed in conjunction with other materials whether they are organic or inorganic. For example, they can be employed with inorganic phosphates, polyphosphates, etc., such as sodium hexametaphorphate, etc.

I have also discovered that alkoxysilyl alkyl alkylene polyamines such as (trimethoxysilyl propyl) ethylene diamine are superior pitting corrosion inhibitors even when employed alone, yielding about 98% pitting corrosion inhibition. Although such compositions are known as corrosion inhibitors as illustrated in U.S. Pat. Nos. 3,716,569 and 3,816,184, I have demonstrated their superiority as pitting corrosion inhibitors. In addition such silyl compositions are useful in preparing synergistic blends with anodic corrosion inhibitors which upgrade the blend.

In general, any effective blend of cathodic or anodic corrosion inhibitors can be employed in this invention.

As to cathodic inhibitors, the preferred class includes phosphorus-containing compounds, for example, esters of an organic moiety with an inorganic moiety. Illustrative of this class are phosphorylated (i.e., phosphate ester, amides, and/or ester-amides, etc.), or phosphonylated (i.e., phosphonic esters, amides, and/or ester-amides, etc.).

The cathodic compounds can also contain atoms other than C, H, O, N. For example, they can contain silicon, etc. A phosphorylated compound relates to a phosphate group whereas a phosphonylated compound relates to a phosphonic group.

As to the anodic inhibitors, they include compounds containing anionic groups. These are illustrated by compounds containing the following groups:

(1) acidic OH groups such as aromatic OH groups of the phenolic type, (2) acidic SH groups such as aromatic SH groups of the thiophenolic or other types such as typical of mercaptobenzothiazole, (3) carboxylate, sulfate, sulfonic, etc. groups or combinations thereof as mono- or poly-functional acids, (4) combination of one or more of the above groups.

A wide variety of hydroxyl or amino compounds may be phosphorylated or phosphonylated to yield the cathodic inhibitors of the invention. They may be mono-, or poly-hydroxyl or amino compounds or may contain both hydroxyl and amino groups. These include the following:

| | |
|---|---|
| $R(OH)_n$ | n = 1-10 or more |
| $R(NH_2)_{n'}$ | n' = 1-10 or more |
| $(H0)_xR(NH_2)_y$ | x = 1-10 or more |
| | y = 1-10 or more |

where R is an organic moiety, such as alkyl, cycloalkyl, alkylene, aryl, etc.

The hydroxyl or amino group may be oxyalkylated with any suitable oxide such as ethylene oxide, propylene oxide, butylene oxide, etc., or combinations thereof, for example $$R(OA)_nOH$$

$$R\,[(OA_n)OH]_x$$

$$\begin{array}{l}(OA)_nH\\ |\\ RN-(OA)_nH,\ \text{etc.}\end{array}$$

$$\begin{array}{c}H(AO)_n\\ |\\ H(AO)_m-N\ R(OA)_pOH\end{array}$$

Polyamines can also be employed such as polyalkylenepolyamines $$NH_2(A\overset{H}{N})_nH \qquad \text{A is alkylene, n = 1-10 or greater}$$

These polyalkylenepolyamines may also be oxyalkylated.

The following are examples:

$CH_3(CH_2)_nOH$ where n=0-40 or greater, for example where n=about 4-28, but preferably about 7-17.

The glycols which may be employed herein can vary widely. In general, they are the glycols conventionally employed in preparing polyesters. Suitable examples include the following: alkylene glycols of the formula $H(OA)_nOH$ where n is for example 1-10 or higher and A is alkylene; ethylene, propylene, butylene, etc., for example ethylene glycol, diethylene glycol, propylene glycol, dipropylene glycol, tripropylene glycol, triethylene glycol, butylene glycol, tetramethylene glycol, neopentyl glycol, 2-methyl-1,3-pentanediol, 1,5-pentanediol, hexamethylene glycol, etc.

The polyols used herein can be widely varied and are those containing at least three esterifiable hydroxyl groups. In general, these are the polyhydric alcohols conventionally employed in preparing polyesters. Illustrative examples of such alcohols are glycerol, polyglycerol, pentaerythritol, mannitol, trimethylolpropane, trimethylo-olethane, 1,2,6-hexanetriol, polypentaerythritol, polyallyl alcohol, polymethallyl alcohol, polyols formed by the condensation of bisphenols with epichlorohydrin, and the like.

The polyamines employed include those of the following formula:

$$NH_2-\left(\overset{N}{\underset{|}{AN}}\right)_n-H$$

where n is for example 1-8 or greater, where A is a divalent radical, for example straight or branched $$-(CH_2)_m-,\ -CH_2-CH_2-,\ -\underset{|}{\overset{CH_3}{CH}}-CH_2-,\ -CH_2\underset{\underset{CH_3}{|}}{CH}-CH_2-,\ \text{etc.}$$

The wgt. ratio of cathodic to anodic inhibitors may vary widely depending on the specific inhibitors employed, the corrosive systems, the metal to be inhibited, etc. In general, the ratio may vary widely such as from about 1 to 99, to about 99 to 1, for example, from about 1 to 3, to about 3 to 1, for example, from about 2 to 3 to about 3 to 2, but preferably of about 1:1.

I claim:

1. A pitting corrosion inhibiting composition comprising a cathodic corrosion inhibitor and an anodic corrosion inhibitor, said cathodic corrosion inhibitor being a phosphoric acid ester, amide, amide-ester or combination thereof, and said anodic corrosion inhibitor being an organic compound containing at least one member of the class consisting of the carboxylic, sulfonic, sulfate and acidic SH groups.

2. A pitting corrosion inhibiting composition comprising a cathodic corrosion inhibitor and an anodic corrosion inhibitor, said cathodic corrosion inhibitor being a phosphoric acid ester, amide, amide-ester or combination thereof and said anodic corrosion inhibitor containing at least one of the following:

2-hydroxy-1,2,3-propanetricarboxylic acid
3,4,5-trihydroxy-benzoic acid
2-phosphono-butane-1,2,4-tricarboxylic acid
2-mercaptobenzothiazole
5,5'-indigosulfonic acid maleic acid
4-hydroxy-3-methoxy-benzaldehyde.

3. The composition of claim 2 where the cathodic corrosion inhibitor is phosphorylated pentaerythritol.

4. The composition of claim 2 containing 4-hydroxy-3-methoxy-benzaldehyde and phosphorylated pentaerythritol.

5. The composition of claim 2 containing 3,4,5-trihydroxy-benzoic acid and phosphorylated pentaerythritol.

6. A pitting corrosion inhibiting composition comprising a cathodic corrosion inhibitor and an anodic corrosion inhibitor, said cathodic corrosion inhibitor being a phosphonic acid ester, amide, amide-ester or combination thereof, and said anodic corrosion inhibitor being an organic compound containing at least one member of the class consisting of the carboxylic, sulfonic, sulfate and acidic OH groups.

7. The composition of claim 6 where the anodic corrosion inhibitor contains at least one of the following:

2-hydroxy-1,2,3-propanetricarboxylic acid
3,4,5-trihydroxy-benzoic acid
2-phosphono-butane-1,2,4-tricarboxylic acid
5,5'-indigosulfonic acid maleic acid
4-hydroxy-3-methoxy-benzaldehyde.

8. A pitting corrosion inhibiting composition comprising an anodic corrosion inhibitor and a cathodic corrosion inhibitor, said anodic corrosion inhibitor containing at least one of the following:

2-hydroxy-1,2,3-propanetricarboxylic acid
3,4,5-trihydroxybenzoic acid
2-phosphono-butane-1,2,4-tricarboxylic acid
2-mercaptobenzothiazole
5,5'-indigosulfonic acid maleic acid
4-hydroxy-3-methoxybenzaldehyde; and said cathodic corrosion inhibitor is phosphonylated (trimethoxysilylpropyl) ethylene diamine or phosphonylated diethylenetriamine.

9. A process of inhibiting pitting corrosion of metallic equipment in an oxygenated aqueous system conducive to such corrosion, which comprises treating such system with a phosphonylated alkylene polyamine containing alkoxysilyl groups.

10. The process of claim 9 where the treating material is a phosphonylated (trialkoxysilylalkyl) alkylene polyamine.

11. The process of claim 9 where the polyamine is (trimethoxysilylpropyl) ethylene diamine.

* * * * *